US005531911A

United States Patent [19]

Adams et al.

[11] Patent Number: 5,531,911

[45] Date of Patent: Jul. 2, 1996

[54] METAL FREE HYDRAULIC FLUID WITH AMINE SALT

[75] Inventors: Paul E. Adams, Willoughby Hills; Thomas G. Hach, Cleveland; James N. Vinci, Mayfield Heights, all of Ohio

[73] Assignee: The Lubrizol Corporation, Wickliffe, Ohio

[21] Appl. No.: 474,051

[22] Filed: Jun. 7, 1995

Related U.S. Application Data

[63] Continuation-in-part of Ser. No. 194,897, Feb. 11, 1994, abandoned.

[51] Int. Cl.[6] ..... C10M 137/10; C10M 135/10

[52] U.S. Cl. ..... 508/408; 508/387; 508/430

[58] Field of Search ..... 252/33, 46.6

[56] References Cited

U.S. PATENT DOCUMENTS

| | | | |
|---|---|---|---|
| 2,157,452 | 5/1939 | Humphreys | 87/9 |
| 2,240,049 | 7/1941 | Moyle | 260/461 |
| 2,242,260 | 5/1941 | Prutton | 252/48 |
| 2,961,404 | 11/1960 | Francis | 252/33.3 |
| 3,005,847 | 10/1961 | Bray | 252/33 |
| 3,149,077 | 9/1964 | Davis | 252/75 |
| 3,254,027 | 5/1966 | Matson et al. | 252/46.6 |
| 3,321,401 | 5/1967 | Ford et al. | 252/46.7 |
| 3,627,681 | 12/1971 | Chandler | 252/32.7 |
| 3,640,872 | 2/1972 | Wiley et al. | 252/75 |
| 3,723,315 | 3/1973 | Sullivan | 252/49.8 |
| 3,784,588 | 1/1974 | Miles | 252/46.6 |
| 3,791,976 | 2/1974 | Messina et al. | 252/75 |
| 4,179,389 | 12/1979 | Mann | 252/32.7 |
| 4,210,541 | 7/1980 | Mann | 252/32.7 |
| 4,249,912 | 2/1981 | Holtz et al. | 252/33 |
| 4,395,286 | 7/1983 | Sturwald | 106/14.13 |
| 4,431,552 | 2/1984 | Salentine | 252/32.7 |
| 4,435,338 | 3/1984 | Michaelis et al. | 252/46.6 |
| 4,487,703 | 12/1984 | Stapp | 252/33 |
| 4,746,450 | 5/1988 | Frentrup et al. | 252/75 |
| 4,897,209 | 1/1990 | Law et al. | 252/32.7 |
| 4,910,243 | 3/1990 | Berndlmaier et al. | 524/160 |
| 4,921,592 | 5/1990 | Allen et al. | 252/33 |
| 5,035,824 | 7/1991 | MacKinnon | 252/33 |
| 5,120,456 | 6/1992 | Goyal et al. | 252/33 |
| 5,320,767 | 6/1994 | Habeeb | 252/33 |

FOREIGN PATENT DOCUMENTS 2002252 5/1990 Canada .

OTHER PUBLICATIONS

Smalheer et al, "Lubricant Additives", pp. 1–11, 1967.

*Primary Examiner*—Ellen M. McAvoy

*Attorney, Agent, or Firm*—David M. Shold; Frederick D. Hunter

[57] ABSTRACT

Functional fluids comprising an oil of lubricating viscosity, the reaction product of an amine and a sulfonic acid, and at least one sulfur-containing compound of the structure $$(RX)_3P{=}X$$

where X is sulfur or oxygen exhibit good anti-rust and antiwear performance.

44 Claims, No Drawings

METAL FREE HYDRAULIC FLUID WITH AMINE SALT

BACKGROUND OF THE INVENTION

This application is a continuation-in-part of U.S. patent application Ser. No. 08/194,897, filed Feb. 11, 1994, now abandoned.

The present invention relates to a functional fluid which contains an amine salt of a sulfonic acid.

Functional fluids such as hydraulic fluids must exhibit extreme pressure antiwear protection properties as well as anti-rust or anti-corrosion properties. A commonly used test of extreme pressure properties of a composition is the FZG test, which is described in an article "Scuffing Tests on Gear Oils in the FZG Apparatus," by Niemann et al., in ASLE Transactions, 4 71–86 (1961). Many formulations have been prepared in an attempt to provide good antiwear and/or anti-rust or anti-corrosion properties, which have found varying degrees of usefulness. Among these are the following:

U.S. Pat. No. 3,791,976, Messina et al., Feb. 12, 1974, discloses a hydraulic fluid consisting of a petroleum base blend and tricresyl phosphate, phenyl-1-naphthylamine, and barium dinonylnaphthalene sulfonate.

U.S. Pat. No. 4,179,389, Dec. 18, 1979, and U.S. Pat. No. 4,210,541, Jul. 1, 1980, both to Mann, disclose stabilized hydraulic fluids containing a zinc bis(dialkyldithiophosphate) as an antiwear agent and a minor amount of zinc dinonylnaphthalene sulfonate.

U.S. Pat. No. 4,395,286, Sturwald, Jul. 26, 1983, discloses a water-based coating composition which upon drying prevents rust and corrosion on metal surfaces. The composition includes a monovalent metal or amine salt of a sulfonic acid such as dinonylnaphthalenesulfonic acid.

U.S. Pat. No. 4,431,552, Salentine, Feb. 14, 1984, discloses a lubricant which contains a phosphate, monothiophosphate, and dithiophosphate in a critical ratio. Sulfur-free phosphates include hydrocarbyl phosphates. Monothiophosphates include O,O,O-trihyrocarbylphosphorothioates; the hydrocarbyl groups may be aromatic or alicyclic. Dithiophosphates include the amine salts of O,O- and O,S-dihydrocarbyldithiophosphates.

SUMMARY OF THE INVENTION

The present invention provides a functional fluid comprising an oil of lubricating viscosity; the reaction product of an amine and a sulfonic acid; and a compound of the structure:

$$(RX)_3P{=}X$$

where each X is independently sulfur or oxygen, provided that at least one X is sulfur, and wherein each R is independently a hydrocarbyl or a substituted hydrocarbyl group.

The invention further provides a functional fluid or a grease comprising an oil of lubricating viscosity; a triarylmonothiophosphate; and a compound of the structure:

$$(RO)_2\overset{\overset{\displaystyle X}{\|}}{P}{-}S_a{-}R''$$

where a is zero or 1, X is sulfur or oxygen, each R and R" is independently an alkyl group or a substituted alkyl group.

The present invention further provides concentrates comprising a concentrate-forming amount of an oleophilic medium and the above-defined additives.

The functional fluids, greases, and concentrates of the present invention can serve as lubricants or related materials; they exhibit useful antiwear properties even though they are preferably formulated without conventional metals such as zinc. Certain of the materials of the present invention moreover are capable of passing stringent filterability and rust tests.

DETAILED DESCRIPTION OF THE INVENTION

The oil of lubricating viscosity. The first and major component of this invention is an oil of lubricating viscosity, including natural or synthetic lubricating oils and mixtures thereof. Natural oils include animal oils, vegetable oils, mineral lubricating oils of paraffinic, naphthenic, or mixed types, solvent or acid treated mineral oils, and oils derived from coal or shale. Synthetic lubricating oils include hydrocarbon oils, halo-substituted hydrocarbon oils, alkylene oxide polymers (including those made by polymerization of ethylene oxide or propylene oxide), esters of dicarboxylic acids and a variety of alcohols including polyols, esters of monocarboxylic acids and polyols, esters of phosphorus-containing acids, polymeric tetrahydrofurans, and silicon-based oils (including siloxane oils and silicate oils). Included are unrefined, refined, and rerefined oils. Specific examples of the oils of lubricating viscosity are described in U.S. Pat. No. 4,326,972.

The lubricating oil in the invention will normally comprise the major amount of the composition. Thus it will normally be at least 50% by weight of the composition, preferably 90% to 99.5%, and most preferably 97 to 99%. As an alternative embodiment, however, the present invention can provide an additive concentrate in which the oil can be up to about 20% by weight, preferably about 1 to about 10%, and the other components, described in more detail below, are proportionately increased. Commonly the concentrate will be formulated such that 1–3% of the concentrate is added to lubricating oil to prepare the finished oil.

The reaction product of an amine and a sulfonic acid. The second component of the present invention is the reaction product of an amine and a sulfonic acid. This component generally serves as an anti-rust agent and is particularly useful when used in the presence of the phosphorus and sulfur-containing compounds described below. The reaction product of an amine and a sulfonic acid can represent a variety of different chemical materials depending on reaction conditions. Under mild reaction conditions the reaction product is commonly a salt, $$R{-}SO_3H{+}NR'_3{\rightarrow}R{-}SO_3^{-}NR'_3H^{+}$$

which can be prepared by the simple mixing of the amine and the sulfonic acid under ambient conditions, optionally in a suitable solvent. Most commonly the product of the amine and the sulfonic acid will be the simple salt, although other products and mixtures of such products are included within the scope of the present invention.

The sulfonic acids useful in the present invention include sulfonic and thiosulfonic acids. Generally sulfonic acids are preferred. The sulfonic acids include mono- or polynuclear aromatic and cycloaliphatic compounds. Sulfonic acids can be represented for the most part by one of the following formulas: $R_2$—T—$(SO_3H)_a$ and $R_3$—$(SO_3H)_b$, wherein T is a cyclic nucleus such as, for example, benzene, naphthalene, anthracene, diphenylene oxide, diphenylene sulfide, petroleum naphthenes, etc.; $R_2$ is an aliphatic group such as alkyl, alkenyl, alkoxy, alkoxyalkyl, etc.; $(R_2)$+T typically contains a total of at least 15 carbon atoms; and $R_3$ is an aliphatic hydrocarbyl group containing typically at least 15 carbon atoms. Examples of $R_3$ are alkyl, alkenyl, alkoxyalkyl, carboalkoxyalkyl, etc. Specific examples of $R_3$ are groups-derived from petrolatum, saturated and unsaturated paraffin wax, and the above-described polyalkenes. The groups T, $R_2$, and $R_3$ in the above Formulas can also contain other inorganic or organic substituents in addition to those enumerated above such as, for example, hydroxy, mercapto, halogen, nitro, amino, nitroso, sulfide, disulfide, etc. In the above Formulae, a and b are at least 1. In one embodiment, the sulfonic acids have a substituent ($R_2$ or $R_3$) which is derived from one of the above-described polyalkenes.

Illustrative examples of these sulfonic acids include monoeicosanyl-substituted naphthalene sulfonic acids, dodecylbenzene sulfonic acids, didodecylbenzene sulfonic acids, dinonylbenzene sulfonic acids, cetylchlorobenzene sulfonic acids, dilauryl beta-naphthalene sulfonic acids, the sulfonic acid derived by the treatment of polybutene having a number average molecular weight (Mn) in the range of 500 to 5000, preferably 800 to 2000, more preferably about 1500 with chlorosulfonic acid, nitronaphthalene sulfonic acid, paraffin wax sulfonic acid, cetyl-cyclopentane sulfonic acid, lauryl-cyclohexane sulfonic acids, polyethylenyl-substituted sulfonic acids derived from polyethylene (Mn=300–1000, preferably 750), etc. Normally the aliphatic groups will be alkyl and/or alkenyl groups such that the total number of aliphatic carbons is at least about 8, preferably at least 12 up to about 400 carbon atoms, preferably about 250.

The sulfonic acid used in the present invention is preferably an aromatic sulfonic acid, as described above, and is preferably substituted (on the aromatic ring) by at least one alkyl group. Preferred acids include mono-, di-, and tri-alkylated benzene and naphthalene (including hydrogenated forms thereof) sulfonic acids. Illustrative of synthetically produced alkylated benzene and naphthalene sulfonic acids are those containing alkyl substituents having from 4 to 30 carbon atoms, preferably 6 to 30 carbon atoms, and advantageously 8 to 24 carbon atoms. Such acids include di-isododecyl-benzene sulfonic acid, polybutenyl-substituted sulfonic acid, polypropylenyl-substituted sulfonic acids derived from polypropene having an Mn=300–1000, preferably 500–700, cetylchlorobenzene sulfonic acid, di-cetyl-naphthalene sulfonic acid, di-lauryldiphenylether sulfonic acid, diisononylbenzene sulfonic acid, di-isooctadecylbenzene sulfonic acid, stearylnaphthalene sulfonic acid, and the like.

Alkyl substituted naphthalene sulfonic acids are quite suitable for use in the present invention, and in particular dialkylnaphthalene sulfonic acids such as dinonylnaphthalenesulfonic acid are preferred.

The production of sulfonic acids from detergent manufactured by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

The amine with which the sulfonic acid is reacted can be any of the well-known amines, including primary, secondary, and tertiary amines. They can be aliphatic amines, both straight chain or branched, cycloaliphatic amines, heterocyclic amines, aromatic amines, or alkyl-substituted aryl amines. The amines can further be monoamines, containing one amine functionality per molecule, or polyamines. Examples of polyamines include alkylene polyamines, hydroxy containing polyamines, arylpolyamines, and heterocyclic polyamines.

Alkylene polyamines are represented by the formula:

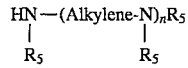

wherein n has an average value 1 or 2 to 10 or 7 or 5, and the "Alkylene" group has 1 about 2 to 10 or 6 or 4 carbon atoms. Each $R_5$ is independently hydrogen or an aliphatic or hydroxy-substituted aliphatic group of up to about 30 carbon atoms.

Such alkylenepolyamines include methylenepolyamines, ethylenepolyamines, butylenepolyamines, propylenepolyamines, pentylenepolyamines. Specific examples of such polyamines are ethylenediamine, diethylenetriamine (DETA), triethylenetetramine (TETA), tris-(2-aminoethyl)amine, propylenediamine, trimethylenediamine, tripropylenetetramine, tetraethylenepentamine, and hexaethylene-heptamine, pentaethylenehexamine. Ethylenediamine is preferred.

A particularly useful reaction product of an amine and a sulfonic acid is the ethylenediamine salt of dinonylnaphthalenesulfonic acid in which two moles of the sulfonic acid are reacted with one mole (two equivalents) of the ethylenediamine. This material is commercially available in concentrate form from King Industries, Norwalk, Conn., under the name NA-SUL™ EDS.

The amount of the above-described reaction product preferably is 0.005 to 3 weight percent of the functional fluid, when the reaction product is the ethylenediamine salt of dinonylnaphthalenesulfonic acid. Preferably the amount is 0.01 to 0.2 weight percent. The preferred amounts may be adjusted if a different reaction product is used, and the amounts will of course be adjusted if the composition is prepared as a concentrate rather than as a finished functional fluid. Such adjustments are well within the ability of a person skilled in the art.

The sulfur and phosphorus-containing compound. The third component of the composition of the present invention is at least one compound of the structure:

$$(RX)_3P{=}X$$

where each X is independently sulfur or oxygen, provided that at least one X is sulfur, and wherein each R is independently a hydrocarbyl or a substituted hydrocarbyl group. This component can be generally described as a thiophosphate, and it is preferably a mixture of two or more materials having one or two sulfur atoms.

Thiophosphates containing one sulfur atom (monothiophosphates) can be prepared by reacting a phosphite with a sulfurizing agent such as sulfur, sulfur halides, and sulfur containing compounds, such as sulfurized olefins, sulfurized fats, mercaptans and the like. The general reaction is believed to be as follows:

$$(RO)_3P+S\rightarrow(RO)_3P{=}S$$

The starting material for preparation of monothiophosphates is a phosphite, $(RO)_3P$, which is a readily available class of materials. In the phosphite and in the resulting monothiophosphate, the three R groups can be the same or different groups including aliphatic, aromatic, and alkyl-substituted aromatic groups. In a preferred embodiment the starting material is a triarylphosphite such as triphenylphosphite. The following example relates to preparation of thiophosphates.

EXAMPLE A

A reaction vessel is charged with 1204 parts (3.69 equivalents) of triphenylphosphite. The phosphite is heated to 160° C. under nitrogen where 112 parts (3.51 equivalents) of sulfur is added over three hours. The reaction temperature is maintained at 160° C. for four hours. (In an alternative process, the mixture is thereafter heated to 195°–200° C. and maintained at that temperature for a period of hours.) The mixture is then filtered through diatomaceous earth and the flitrate is the desired product. The filtrate contains 8.40% phosphorous (8.7% theory) and 8.4% sulfur (8.50% theory).

Triphenylthiophosphate is sold by Ciba-Geigy under the trade name Irgalube TPPT™. Other suitable monothiophosphates include tricresylthiophosphate, tri-p-dodecylphenylthiophosphate, trioctylthiophosphate, tri-p-t-butylphenylthiophosphate, tri-β-naphthylthiophosphate, trilaurylthiophosphate, tri-p-heptylphenylthiophosphate, thiophosphates based on sulfur-coupled alkylphenols.

The thiophosphate can also be a material containing more than one sulfur atom. Such materials can be prepared by reacting hydroxy or mercapto compounds with phosphorus pentasulfide to form an intermediate, according to reactions believed to be:

$$2ROH+\tfrac{1}{2}P_2S_5\rightarrow(RO_2)P(=S)SH+\tfrac{1}{2}H_2S$$

$$ROH+RSH+\tfrac{1}{2}P_2S_5\rightarrow(RO)(RS)P(=S)SH+\tfrac{1}{2}H_2S$$

$$2RSH+\tfrac{1}{2}P_2S_5\rightarrow(RS)_2P(=S)SH+\tfrac{1}{2}H_2S$$

Each of the intermediates can be further reacted with an activated olefin $CH_2{=}CHA$, where A is an activating group such as acid or ester substituent (either —C(O)OR or —OC(O)R):

$$(RX)_2P(=S)SH + CH_2{=}CHA \longrightarrow (RX)_2P(=S)S-CH_2CH_2A \text{ or } (RX)_2P(=S)S-\underset{\underset{CH_3}{|}}{CHA}$$

The first of the preceding products is believed to be predominantly formed when A is —C(O)OR, the second when A is —OC(O)R.

Alternatively, the intermediates can be reacted in a variety of ways to provide additional materials useful for the present invention:

$$(RX)_2P(=S)SH + \overset{O}{\diagup\!\!\diagdown}CH_2-CH-R \longrightarrow (RX)_2P(=S)-S-CH_2CH(OH)R$$

$$(RO)_2P(=S)SH + P_2S_5 \longrightarrow (RS)_3P{=}S + P_2O_nS_{5-n} + xH_2S$$

For the above reaction, when R=2-ethylhexyl, the reactants can be reacted at 85° C., increasing to 160° C., with stirring under nitrogen. Aromatic equivalents can also be prepared.

$$(RS)_3P+S\rightarrow(RS)_3P{=}S$$

For the above reaction, trilauryltrithiophosphate (available from GE Specialty Chemicals) can be reacted with sulfur under nitrogen with stirring at 85°–160° C. Aromatic equivalents can also be prepared.

In a preferred embodiment the sulfur and phosphorus-containing compound contains an ester functional group and can be prepared by reaction with an acid or ester-containing olefin, as illustrated above. Such an ester is therefore prepared by reaction of a dithiophosphoric acid and an alpha, beta unsaturated carboxylic compound, such as an acrylic or methacrylic acid or ester. If the carboxylic acid is used, the ester can be formed, if desired, by subsequent reaction, known to those skilled in the art. The unsaturated carboxylic esters can contain 4 to 40, preferably 4 to 24, and more preferably 4 to 12 carbon atoms. Preferably, the unsaturated carboxylic ester is an allyl or vinyl ester of a carboxylic acid or an ester of an unsaturated carboxylic acid.

The vinyl ester of a carboxylic acid can be represented by the formula $R_6CH{=}CH—O(O)CR_7$ wherein $R_6$ is a hydrogen or hydrocarbyl group having from 1 to 30 carbon atoms, preferably 1 to 12 carbon atoms, and more preferably hydrogen; and $R_7$ is a hydrocarbyl group having 1 to 30 carbon atoms, preferably 1 to 12 and more preferably 1 to 8 carbon atoms. Examples of vinyl esters include vinyl acetate, vinyl 2-ethylhexanoate, vinyl butanoate, and vinyl crotonate.

In another embodiment, the unsaturated carboxylic ester is an ester of an unsaturated carboxylic acid such as maleic, fumaric, acrylic, methacrylic, itaconic, citraconic acids, and the like. In one embodiment, the ester is represented by the formula $R_8O—(O)C—CH{=}CH—C(O)OR_8$, wherein each $R_8$ is independently a hydrocarbyl group having 1 to 18 carbon atoms, preferably 1 to 12 and more preferably 1 to 8 carbon atoms.

Examples of unsaturated carboxylic esters, useful in the present invention, include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate, and 2-ethylhexyl maleate. The foregoing list includes mono- as well as diesters of maleic, fumaric, and citraconic acids.

The following examples relate to the preparation of ester-containing materials:

EXAMPLE B

A mixture of butyl alcohol and amyl alcohol (4 moles) and powdered $P_2S_5$ (1 mole) are introduced into a reactor and maintained at 65°–75° C. for several hours, with evolution of $H_2S$. The intermediate, dialkyldithiophosphoric acid, is purified by filtration.

The dialkyldithiophosphoric acid, 668 g, is placed in a 2 L flask and 145 g methyl acrylate is added in one portion. The components react exothermically; the mixture is heated to 110°–115° C. under nitrogen and maintained at temperature for 14 hours. The product is purified by filtration over diatomaceous earth filter aid.

EXAMPLE C

The dialkyldithiophosphoric acid intermediate of Example B, 968 g, is placed in a 2 L flask. Vinyl acetate, 278 g, is added in 1 portion. The mixture is heated under nitrogen at 95°–100° C. for 6 hours and then cooled. The reaction mixture is washed with a solution of 31.8 g sodium carbonate in 400 mL water, followed by washing with 400 mL water alone. The organic layer is separated and vacuum stripped at 100° C., (10 mm) pressure, for 3 hours. The product is purified by filtration over diatomaceous earth filter aid.

In one embodiment, the phosphorus-containing material is an ester represented by the formula:

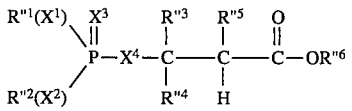

wherein each $X^l$, $X^2$, $X^3$, and $X^4$ is independently oxygen or sulfur;

$R''^1$, $R''^2$, and $R''^6$ are independently hydrocarbyl or substituted hydrocarbyl groups;

$R''^3$, $R''^4$, and $R''^5$ are independently hydrogen or hydrocarbyl groups; and $X^1$ and $X^2$ are preferably oxygen, and $X^3$ and $X^4$ are preferably sulfur.

Each $R''^1$ and $R''^2$ is independently a hydrocarbyl group or a substituted hydrocarbyl group of 1 to 50 carbon atoms, preferably 1 to 30 carbon atoms, more preferably 3 to 18 carbon atoms, and more preferably up to 8 carbon atoms. Each $R''^1$ and $R''^2$ is preferably independently an alkyl group or an alkoxyalkyl group, most preferably an alkyl group. Examples of $R''^1$ and $R''^2$ include independently, t-butyl, isobutyl, amyl, isooctyl, decyl, dodecyl, eicosyl, 2-pentenyl, dodecenyl, phenyl, naphthyl, alkylphenyl, alkylnaphthyl, phenylalkyl, naphthylalkyl, alkylphenylalkyl, and alkylnaphthylalkyl groups. $R''^1$ and $R''^2$ can also be alkoxyalkyl groups of the structure $R'''(O—(CH_2)_m)_n—$, where m is 2–6, preferably 2, n is 1–10, and R''' is a hydrocarbyl group. Such alkoxyalkyl groups include polyethylene oxide groups. Preferably the $R''^1$ and $R''^2$ groups are branched alkyl groups, and most preferably they are a mixture of branched groups of 4 to 5 carbon atoms.

Preferably each $R''^3$, $R''^4$, and $R''^5$ is independently a hydrogen or hydrocarbyl group of from 1 to 50 carbon atoms. More preferably each such group is independently a hydrogen, an alkyl group of 1 to 22 carbon atoms, a cycloalkyl group of 4 to 22 carbons, or an aromatic, alkyl-substituted aromatic, or aromatic-substituted alkyl group of 4 to 34 carbon atoms. Most preferably each such group is hydrogen.

$R''^6$ is preferably an alkyl group of 1 to 22 carbon atoms, a cycloalkyl group of 4 to 22 carbon atoms, or an aromatic, alkyl-substituted aromatic, or aromatic-substituted alkyl group of 4 to 34 carbon atoms.

In one preferred embodiment, the phosphorus and sulfur-containing component of the present composition comprises a mixture of at least two compounds, one of which is a triaryl thiophosphate, preferably a triaryl monothiophosphate, and the second is a compound of the structure

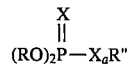

where a is zero or 1, each X is independently sulfur or oxygen, and each R and R" is independently an alkyl group or a substituted alkyl group. This material will preferably contain at least one sulfur atom, more preferably two sulfur atoms, although it may also contain zero sulfur atoms. This second phosphorus material is preferably is a thiophosphate ester, and more preferably a dithiophosphate ester of the structure:

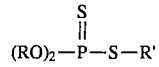

wherein each R is an alkyl group and R' is a carboxylic ester-substituted alkyl group. The presence of such a mixture of materials leads to improved performance on the FZG test. In one preferred combination the first component is triphenylmonothiophosphate and the second is a material in which the R groups are mixed branched $C_4$ and $C_5$ alkyl groups and R' is $—CH_2CH_2CO_2CH_3$. In another embodiment, R' is —CH(CH3)—O—C(=O)—$CH_3$. In such mixtures it is preferred that the triaryl thiophosphate and the thiophosphate ester are present in relative amounts by weight of 10:90 to 90:10, and preferably 20:80 to 60:40.

The compositions of the present invention can also contain phosphorus-containing compounds other than the preferred materials already described in detail, and such mixtures can also lead to good FZG performance. Examples of such other compounds are materials having a structure:

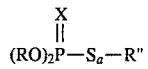

where a is zero or 1, X is sulfur or oxygen, and each R and R" is independently an alkyl group or a substituted alkyl group. When X is sulfur and a is 1, the formula corresponds to

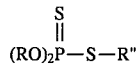

which encompasses the materials described above, including the thiophosphate esters, e.g. where each R is a branched alkyl group of up to 8 carbon atoms and R" is $—CH_2CH_2CO_2CH_3$. However, other compounds are also included, in which a is zero. These include phosphonates and thiophosphonates prepared by the reaction of $(RO)_2P(=X)H$ (dialkyl hydrogen phosphite or—thiophosphite) with an activated olefin $CH_2=CHA$ as described above, where A is an activating group such as ester substituent (either —C(O)OR or —OC(O)R). Such a reaction is thought to proceed largely as shown:

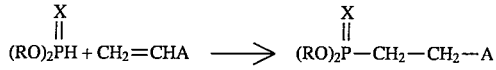

This reaction is normally conducted in the presence of a base such as sodium methoxide or an epoxide. Suitable activated olefins include those described in greater detail above, including vinyl alkanoates such as vinyl acetate and alkyl acrylates and alkyl methacrylates, such as methyl acrylate.

Alternatively, amino-substituted phosphonates can be prepared by the reaction

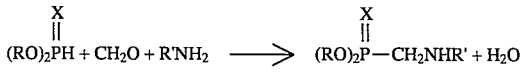

where R' is a hydrocarbyl group such as an alkyl group, and preferably a tertiary alkyl group such as t-butyl, t-octyl, or a t-$C_{11}$–$C_{14}$ alkyl mixture. Suitable materials include O,O-di-n-butyl(N-t-butylaminomethyl)phosphonate, diphenyl(N-diamylaminomethyl)phosphonate, dioctyl(n-didodecylaminomethyl)phosphonate, and dicyclohexyl(N-t-$C_{11-14}$ alkylaminomethyl)phosphonate.

Additional materials can be prepared by effecting a rearrangement of a trihydrocarbyl phosphite at elevated temperature (160°–200° C.) in the presence of an alkyl halide catalyst:

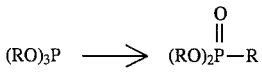

Suitable combinations include combinations of triarylmonothiophosphates and the above-described functionalized phosphonates. Examples of such materials are di-n-butyl(n-butylphosphonate).

The following examples related to the preparation of such phosphorus-containing compounds:

EXAMPLE D

Two hundred ninety-one grams of di-n-butyl hydrogen phosphite ("DNBP") is charged to a 1 L 4-neck flask fitted with a stirrer, subsurface nitrogen inlet, cold water condenser, dry ice condenser and thermowell. The material is heated to 60° C. Vinyl acetate, 129 g, is added to the flask over a period of 1 hour using an addition funnel. Thereafter the mixture is heated to 90° C. and maintained at temperature for 3.5 hours, and thereafter maintained at 100° C. for 5.5 hours. Thereafter the mixture is heated to 115° C. and 0.5 g di-t-butyl peroxide is added and the mixture maintained at 115°–120° C. for 5.5 hours. The reaction mixture is vacuum stripped for 2 hours at 80°–140° C. at 250 Pa (1.9 mm Hg) pressure and the resulting material vacuum filtered to isolate the product.

EXAMPLE E

Two hundred ninety-one grams di-n-butyl hydrogen phosphite is charged to a 1-L flask similar to that of Example D. Methyl acrylate, 129 g, is added over 20 minutes; the temperature remains at room temperature. A solution of sodium methoxide, 13 g as a 25 weight percent solution in methanol is added over a period of several hours, during which time an exothermic reaction occurs. The flask is cooled with a water bath to maintain the temperature near room temperature. Thereafter the mixture is heated to 125° C. and maintained at temperature for 4 hours. The mixture is vacuum stripped for 1 hour at 120° C. and 130 Pa (1 mm Hg) pressure. The product is isolated by filtration.

EXAMPLE F

Tributyl phosphite, 202 g, and n-bromobutane (a catalytic amount of 5 g) is placed in the flask of Example D and heated to 150° C., increasing the temperature to 200° C. over a course of for 5 hours, and maintained at 200° C. for a total of 14 hours (on two successive days). The product is isolated by filtration.

EXAMPLE G

A t-$C_{11-14}$ alkylamine, 185 g, and 200 mL toluene are charged to the flask of Example E, further equipped with a Dean-Stark trap. The mixture is heated to reflux, and formaldehyde (paraformaldehyde), 33 g, is added in portions over 2.5 hours; the mixture is held at 125°–130° C. for an additional 2 hours, while water of reaction is collected. Thereafter di-n-butyl hydrogen phosphite, 176 g, is added by addition funnel over 1.5 hours and the mixture is held at 130°–135° C. for an additional 2 hours. The toluene solvent is removed by vacuum distillation and the product purified by filtration.

The preferred combinations of triarylthiophosphates and dithiophosphate carboxylic ester or functionalized phosphonates, described above, can be employed as antiwear additives for functional fluids, if desired, even in the absence of the reaction product of the amine and the sulfonic acid. The use of this combination of materials provides improved results in the FZG extreme pressure test compared with the use of either component alone. However, for best performance, including successful passing of filterability tests, it is preferred that an anti-rust agent, preferably the amine reaction product described above, be present as well.

If two phosphorus-containing components are used, their amounts are preferably those relative amounts which will lead to an improvement in the FZG performance. Typically a trialkylmonothiophosphate and a second phosphorus-containing component will be used in weight ratios of 10:90 to 90:10, and preferably 20:80 to 60:40. Preferably the amounts of the two phosphorus-containing materials are each 0.05 to 2 weight percent, preferably 0.1 to 1 weight percent, and more preferably about 0.3 weight percent. The total amount of the phosphorus-containing component or components in the compositions of the present invention is preferably 0.02 to 5 weight percent of the fluid, and more preferably 0.2 to 2 weight percent. Of course, proportionately larger quantities of each material will be present in a concentrate.

Antioxidants. The compositions of the present invention preferably also contain an effective amount of an antioxidant, normally 0.02 to 2 weight percent of the fully compounded fluid. Antioxidants comprise a wide class of well-known materials, including notably hindered phenols and aromatic amines. Hindered phenols are generally alkyl phenols of the formula:

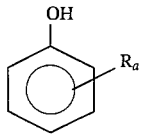

wherein R is an alkyl group containing from 1 up to about 24 carbon atoms and a is an integer of from 1 up to 5. Preferably R contains from 4 to 18 carbon atoms and most preferably from 4 to 12 carbon atoms. R may be either straight chained or branched chained; branched chained is preferred. The preferred value for a is an integer of from 1 to 4 and most preferred is from 1 to 3. An especially preferred value for a is 2. When a is not 5, it is preferred that the position para to the OH group be open.

The hindered phenolic antioxidant is an alkyl phenol, however, mixtures of alkyl phenols may be employed. Preferably the phenol is a butyl substituted phenol containing 2 or 3 t-butyl groups. When a is 2, the t-butyl groups normally occupy the 2,6-position, that is, the phenol is sterically hindered:

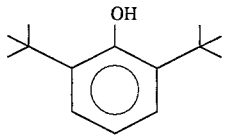

When a is 3, the t-butyl groups normally occupy the 2,4,6-position. Other substituents are permitted on the aromatic ring. In one embodiment the hindered phenolic antioxidant is a bridged compound in which two or more aromatic rings are linked by a bridging group; each aromatic ring bears a phenolic OH group. Examples of phenolic antioxidants include 2,6-di-t-butyl-p-cresol and 4,4'-methylenebis(2,6-di-t-butylphenol). These and other hindered phenolic antioxidants and their methods of preparation are well known to those skilled in the art. Such antioxidants are commercially available; one example of such a material is 2,6-di-t-butylphenol, available from Ethyl Corporation as Ethyl 701™.

Aromatic amine antioxidants include aromatic amines of the formula

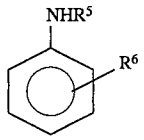

wherein $R^5$ is

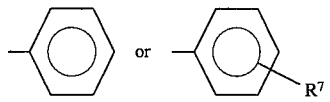

and $R^6$ and $R^7$ are independently a hydrogen or an alkyl group containing from 1 up to 24 carbon atoms. Preferably $R^5$ is

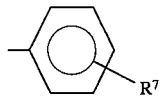

and $R^6$ and $R^7$ are alkyl groups containing from 4 up to about 20 carbon atoms. A particularly useful amine antioxidant is an alkylated diphenylamine such as nonylated diphenylamine of the formula

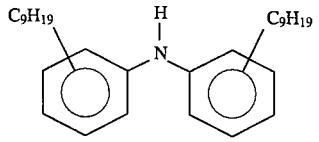

Aromatic amine antioxidants and their preparation are well known to those skilled in the art. These materials are commercially available and are supplied as Naugalube 438L™ by Uniroyal Chemical Company.

Other types of antioxidants include alkylated hydroquinones, hydroxylated thiodiphenyl ethers, alkylidene bisphenols, acylaminophenols, esters or amides of β-(3,5-di-(branched alkyl)-4-hydroxyphenyl)propionic acids, aliphatic or aromatic phosphites, esters of thiodipropionic acid or thiodiacetic acid, and amine or metal salts of dithiocarbamic or dithiophosphoric acids.

The antioxidant component used in the present invention is preferably a mixture of one or more hindered phenol antioxidants and one or more aromatic amine antioxidants. Such a combination provides good antioxidant performance over a wide temperature range.

Other additives. The compositions of the present invention can also contain other additives which are typically used for the application at hand. Some of the other agents which can be employed include corrosion inhibitors; metal deactivators; other rust inhibitors; and extreme pressure and anti-wear agents, which include chlorinated aliphatic hydrocarbons, boron-containing compounds including borate esters, and molybdenum compounds. Viscosity improvers can also be present, which include polyisobutenes, polymethacrylate acid esters, polyacrylate acid esters, diene polymers, polyalkyl styrenes, alkenyl aryl conjugated diene copolymers, polyolefins and multifunctional viscosity improvers. Pour point depressants can also be used if desired, as well as dispersing agents or surfactants. Antifoam agents can be used to reduce or prevent the formation of stable foams, including silicones or organic polymers such as acrylate polymers; a specific example is a copolymer of ethyl acrylate, ethylhexyl acrylate, and vinyl acetate. Demulsifiers can also be present; they include trialkyl phosphates, polyethylene glycols, alkyl amines, amino alcohols, and carboxylic acids. Metal deactivators such as benzotriazole, tolyltriazole, and derivatives thereof can also be used.

Many of the above and other additives are described in greater detail in U.S. Pat. No. 4,582,618 (column 14, line 52 through column 17, line 16, inclusive); others are described in Canadian patent publication 2,002,252. Preferably the additional additives will not include metal ions, so the total composition can be substantially or entirely metal free or sulfated ash free.

Greases. As has been stated above, the additive composition of the present invention can also be employed in a grease composition. Greases are typically prepared by thickening an oil base stock using a thickener, also referred to as a thickening agent. The oil base stock for greases can be an oil of lubricating viscosity, as has been described in detail above. The most common such oil is a mineral oil.

Thickening agents can be categorized as simple metal soap thickeners, soap complexes, and non-soap thickeners. Simple metal soap thickeners are well known in the art. The term "simple metal soaps" is generally used to indicate the substantially stoichiometrically neutral metal salts of fatty acids. By substantially stoichiometrically neutral is meant that the metal salt contains 90% to 110% of the metal required to prepare the stoichiometrically neutral salt, preferably about 100%, e.g., 95% to 102%.

Fatty acids are defined herein as carboxylic acids containing 8 to 24, preferably 12 to 18 carbon atoms. The fatty acids are usually monocarboxylic acids. Examples of useful fatty acids are capric, palmitic, stearic, oleic and others. Mixtures of acids are useful. Preferred carboxylic acids are linear; that is, they are substantially free of hydrocarbon branching. Particularly useful acids are the hydroxy-substituted fatty acids such as hydroxy stearic acid wherein one or more hydroxy groups may be located at positions internal to the carbon chain, such as 12-hydroxy-, 14-hydroxy-, etc. stearic acids.

While the soaps are fatty acid salts, they need not be, and frequently are not, prepared directly from fatty acids. The typical grease-making process involves saponification of a fat which is often a glyceride or of other esters such as methyl or ethyl esters of fatty acids, preferably methyl esters, which saponification is generally conducted in situ in the base oil making up the grease.

Whether the metal soap is prepared from a fatty acid or an ester such as a fat, greases are usually prepared in a grease kettle, forming a mixture of the base oil, fat, ester or fatty acid and metal-containing reactant to form the soap in-situ. Additives for use in the grease may be added during grease manufacture, but are often added following formation of the base grease.

The metals of the metal soaps are typically alkali metals, alkaline earth metals and aluminum. For purposes of cost and ease of processing, the metals are incorporated into the thickener by reacting the fat, ester or fatty acid with basic metal containing reactants such as oxides, hydroxides, carbonates and alkoxides (typically lower alkoxides, those containing from 1 to 7 carbon atoms in the alkoxy group). The soap may also be prepared from the metal itself although many metals are either too reactive or insufficiently reactive with the fat, ester or fatty acid to permit convenient processing. Preferred metals are lithium, sodium, calcium, magnesium, barium and aluminum. Especially preferred are lithium, aluminum, and calcium; lithium is particularly preferred.

Preferred fatty acids are stearic acid, palmitic acid, oleic and their corresponding esters, including glycerides (fats). Hydroxy-substituted acids and the corresponding esters, including fats are particularly preferred.

Complex greases are those which are prepared using soap-salt complexes as the thickening agent and are likewise well-known to those skilled in the art. Soap-salt complexes comprise salts of a fatty acid or ester and a non-fatty acid or ester. Fatty acids have been described in detail above; non-fatty acids typically include short chain (e.g. 6 or fewer carbon atoms) alkanoic acids such as acetic acid; benzoic acid; and diacids such as azeleic acid and sebacic acid. Sometimes medium weight acids (e.g. caprylic, capric) are also included in the mixture. Examples of such soap complex thickeners, then, include metal soap-acetates, metal soap-dicarboxylates, and metal soap-benzoates. Widely used soap-salt complexes include aluminum stearate-aluminum benzoate, calcium stearate-calcium acetate, barium stearate-barium acetate, and lithium 12-hydroxystearate-lithium azelate.

Preparation of complex greases is well known. In some instances (calcium complex greases, for example) a short-chain alkanoic acid is reacted with a metal base (e.g. lime) while the fatty acid salt is being formed. Alternatively, a two-step process can be employed, in which a normal soap is formed, which is then "complexed" by reaction with additional metal base and low weight acid. In other instances the procedure can be more complicated, if for example the acids and bases do not efficiently react together directly. Various methods of preparing complex greases are is described, in more detail on pages 2.13–2.15 of *NLGI Lubricating Grease Guide,* National Lubricating Grease Institute, Kansas City, Mo. (1987).

Non-soap greases are prepared using non-soap thickeners. These include inorganic powders such as organo-clays, fine fumed silicas, fine carbon blacks, and pigments such as copper phthalocyanine. Other non-soap greases employ polymeric thickeners such as polyureas. The polyureas can be formed in situ in the grease by mixing oil with suitable amines in a grease kettle, and slowly adding an oil solution of an isocyanate or a diisocyanate. Non-soap thickeners are described in pages 2.15–2.17 of *NLGI Lubricating Grease Guide.*

Thickeners are incorporated into a base oil, in amounts typically from about 1 to about 30% by weight, more often from about 1 to about 15% by weight, of the base grease composition. In many cases, the amount of thickener used to thicken the base oil constitutes from about 5% to about 25% by weight of base grease. In other cases from about 2% to about 15% by weight of thickener is present in the base grease. The specific amount of thickener required often depends on the thickener employed. The type and amount of thickener employed is frequently dictated by the desired nature of the grease. The type and amount of thickener employed are also dictated by the desired consistency, which is a measure of the degree to which the grease resists deformation under application of force. Consistency is usually indicated by the ASTM Cone penetration test, ASTM D-217 or ASTM D-1403. Types and amounts of thickeners to employ are well-known to those skilled in the grease art and is further described in the *NLGI Lubricating Grease Guide.*

The additives described above can advantageously be used in any of the above-described greases, to provide improved extreme pressure and rust-inhibiting properties. The amount of the reaction product of amine and sulfonic acid, if present in a grease, is typically 0.05 to 10 percent by weight of the grease, and preferably 0.1 to 3 percent by weight. The amount of the sulfur and phosphorus containing compound or compounds is typically 0.5 to 8 percent by weight. Preferably two separate phosphorus containing compounds are employed, as described above, preferably each being present in amounts of 0.5 to 4% by weight. Other additives which are commonly employed in greases, can also be present in customary amounts for their known functions. Examples of such materials are anti-oxidants, additional extreme pressure agents, friction modifiers, metal deactivators, tack modifiers, adhesion modifiers, and materials which modify the water shedding properties of the grease.

Grease formulations of the present invention can be prepared by mixing the base grease with the additives at a modestly elevated temperature, typically 40°–90° C. (100°–200° F.), preferably about 75° C. (170° F.). The mixing should be thorough enough to fully distribute the additives throughout the grease; commonly employed equipment can be used to effect this mixing.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

EXAMPLES

Example 1

A composition is prepared of mineral oil containing a base package of additives for a hydraulic fluid. The additive package is free from metal salts and comprises an aromatic amine antioxidant, a hindered phenol antioxidant, a demulsifier, an antifoam agent, and a triazole metal deactivator. The total amount of these additives is about 0.54 percent by weight. To this composition is added 0.25 weight percent triphenyl monothiophosphate, 0.35 weight percent of the dithiophosphate ester of Example B, and 0.05 weight percent NA-SUL™ EDS, the ethylenediamine salt of dinonylnaphthalenesulfonic acid.

The resulting composition is tested in a Neimann (FZG) Four-Square Gear Test Rig, which consists of two gear sets, arranges in a four-square configuration, driven by an electric motor. When the test is run, a test gear is set in a test fluid, while increasing load stages (from 1 to 13) until failure. Each load stage is run for a 15 minute period. A visual rating method is used for determining the damage load stage. The visual method defines the damage load stage as the stage at which more than 20% of the load-carrying flank area of the pinion is damaged by scratches and/or scuffing. (An alternative method is the weight loss method, which defines the damage load stage as the stage at which the combined weight loss of the drive wheel and pinion exceeds the average of the weight changes in the previous load stages by more than 10 mg.) The composition of this Example exhibits a value of 11 in the FZG test (DIN 51524). The composition also exhibits a passing value of 1.6 in the standard AFNOR Wet Filterability test E-48-691. The results of this test are expressed in terms of the fluid filterability index ("IF"). For a given fluid the IF is defined by the relationships $$IF_1 = \frac{T_{300} - T_{200}}{2T_{50}} \quad \text{or} \quad IF_2 = \frac{T_{300} - T_{200}}{2(T_{100} - T_{50})}$$

where $T_n$ is the time required for n $cm^3$ of a fluid (the same fluid for each measurement) to pass through a test membrane. (The $IF_2$ value is used herein unless otherwise indicated.) The closer the value of IF to the ideal value of 1, the better the filterability of the fluid. The test membrane or diaphragm has an effective filtering surface area of 11.3 $cm^2$ and an overall diameter of 47 mm; the membrane is preferably cellulose ester having an absolute stopping power of 0.8 mm (particle size). The material to be tested is passed through the membrane under an applied pressure, measuring the time required for 300 $cm^3$ of fluid to pass, at 50 $cm^3$ intervals. The pressure employed is normally 100 kPa (1.0 bar), although it can be reduced or increased if the flow of liquid is unusually slow or fast. The filterability index is the average of three successive runs.

The composition further exhibits good rust performance and thermal stability.

Examples 2–21

Compositions are prepared in mineral oil, typically Sun™ 250 neutral oil, containing a baseline additive composition typical for hydraulic fluids, which includes about 0.5 to 0.7% by weight of a combination of an aromatic amine antioxidant and a hindered phenol antioxidant and smaller amounts of other, conventional additives such as viscosity index improvers, dispersants, anti-foam agents, metal deactivators, and demulsifiers. (The amounts and identities of these other additives may vary slightly from example to example, so precise comparisons among the examples are not appropriate. However, the differences introduced by these other additives are not believed to be significant.) To each composition is added a combination of phosphorus-containing materials, a first material which is triphenylthiophosphate or a related material, and a second phosphorus-containing material as indicated in Table I. In certain cases the sample includes the amine rust inhibitor (amine salt) of Example 1 (NA-SUL™ EDS), at a level of about 0.05%. In other cases an alternative (acidic) rust inhibitor is used (not specifically noted), at approximately the same level. Results of the FZG tests on these samples are presented in Table 1 (along with Example 1).

TABLE 1

| Ex | 1st Material | % | 2nd Material | % | Amine salt | FZG |
|---|---|---|---|---|---|---|
| 2 | Triphenylmonothio-phopsphate ("TPTP") | 0.25 | Dithiophosphate ester ("DTPE") of Ex. B | 0.35 | Y | 11 |
| 1 | TPTP | 0.4 | DTPE of Ex. B | 0.5 | Y | 12 |
| 3 | TPTP | 0.25 | DTPE of Ex. B | 0.3 | — | 12 |
| 4 | TPTP | 0.2 | DTPE of Ex. B | 0.5 | — | 12 |
| 5 | TPTP | 0.4 | DTPE of Ex. C | 0.2 | — | |
| 6 | TPTP | 0.3 | Adduct of di-n-butyl phosphite and vinyl acetate ("DNBP/VA") of Ex. D | 0.3 | — | 12 |
| 7 | TPTP | 0.2 | DNBP/VA of Ex. D | 0.2 | — | |
| 8 | TPTP | 0.2 | DNBP adduct with divinyl adipate (2:1) | 0.2 | — | 10 |
| 9 | TPTP | 0.2 | DNBP adduct with methyl acrylate of Ex. E | 0.2 | — | 8 |
| 10 | TPTP | 0.2 | adduct of di-$C_{8-10}$ phosphite + tetraethylene glycol diacrylate (2:1, molar) | 0.2 | — | 6 |
| 11 | TPTP | 0.2 | DNBP adduct with formaldehyde and primary t-$C_{11}$ alkane amine, of Ex. G | 0.2 | — | 7 |
| 12 | TPTP | 0.2 | dibutyl n-butylphosphonate of Ex. F $(BuO)_2P(=O)Bu$ | 0.2 | — | 8 |
| 13 | TPTP | 0.2 | tri(2-ethylhexyl)-monothiophosphate | 0.2 | — | 6 |
| 14 | tri(p-n-$C_{12}$-phenyl)-thiophosphate | 0.21 | DTPE of Ex. B | 0.5 | — | 11 |
| 15 | tri-(o/m-cresyl)thio-phosphate | 0.4 | DTPE of Ex. B | 0.5 | — | 9 |
| 16 | tri(n-$C_{12}$)-tetrathio-phosphate | 0.21 | DTPE of Ex. B | 0.5 | — | 11 |

TABLE 1-continued

| Ex | 1st Material | % | 2nd Material | % | Amine salt | FZG |
|---|---|---|---|---|---|---|
| 17 | tri-(n-$C_{12}$)-tetrathio-phosphate | 0.2 | DTPE of Ex. C | 0.2 | — | 6 |
| 18 | tri(o/m-cresyl)-thio-phosphate | 0.21 | DTPE of Ex. C | 0.2 | — | 10 |
| 19 | tri(p-n-$C_{12}$-phenyl)-thiophosphate | 0.21 | DTPE of Ex. C | 0.2 | — | 8 |
| 20 | TPTP | 0.3 | dibutyl n-butylphos-phonate of Ex. F[1] | 0.3 | Y | 8 |
| 21 | TPTP | 0.2 | DTPE of Ex. C | 0.2 | — | 9 |

[1]A commercial sample from Albright & Wilson Co.

The results show that antiwear protection is obtained in the above compositions. The degree of protection generally is a function of the concentration of the active ingredients in the sample; for more complete protection, the amounts of additives can be increased. Those samples exhibiting relatively lower FZG values can be thus improved, if desired, by increasing the amounts of one or both major ingredients by an appropriate amount. The amounts can be reduced, if desired, for less demanding applications. Those samples which are indicated as containing amine salt (i.e. the amine salt of alkylnaphthalene sulfonic acid) also exhibit good cold filterability.

Examples 22–30

The following compositions are likewise prepared:

TABLE II

| Ex | 1st Mat'l | % | 2nd Material | % | Rust Inhibitor | % |
|---|---|---|---|---|---|---|
| 22 | TPTP | 0.05 | DTPE of Ex. B | 0.3 | NA-SUL ™ EDS | 0 |
| 23 | TPTP | 2.0 | DTPE of Ex. B | 0.3 | NA-SUL ™ EDS | 0.01 |
| 24 | TPTP | 0.3 | DTPE of Ex. B | 0.05 | NA-SUL ™ EDS | 0.2 |
| 25 | TPTP | 0.3 | DTPE of Ex. B | 2.0 | NA-SUL ™ EDS | 3 |
| 26 | TPTP | 5.0 | none | 0 | NA-SUL ™ EDS | 1 |
| 27 | tri-β-naph-thylthio-phosphate | 0.6 | diphenyl(N-diam-ylaminomethyl)-phosphonate | 0.3 | dodecylbenzene sulfonic acid + diethylene-triamine | 0.1 |
| 28 | trilauryl-thiophos-phate | 0.3 | tri(2-ethylhexyl)-tetrathiophosphate | 0.2 | lauryl-cyclo-hexane sulfonic acid + ethyl-amine | 0.1 |
| 30 | none | 0 | DTPE of Ex. B | 4.0 | NA-SUL ™ EDS | 0.1 |

Examples 31–38

Grease compositions are prepared by combining a base grease formulation with the components of the present invention, as indicated below, as well as customary additives not specifically set forth:

TABLE III

| Ex | Grease Type | 1st Mat'l | % | 2nd Mat'l | % | Rust Inhib. | % |
|---|---|---|---|---|---|---|---|
| 31 | Li 12-hy-droxy ste-arate | TPTP | 1.5 | see Ex. 12 | 1.5 | NA-SUL ™ EDS | 0.05 |
| 32 | Li 12-hy- | TPTP | 0.5 | DNBP/VA | 0.5 | same | 10.0 |

TABLE III-continued

| Ex | Grease Type | 1st Mat'l | % | 2nd Mat'l | % | Rust Inhib. | % |
|---|---|---|---|---|---|---|---|
| | droxy stearate | | | of Ex. D | | | |
| 33 | Al complex | TPTP | 4.0 | see Ex. 27 | 4.0 | same | 0.05 |
| 34 | Al complex | TPTP | 3.0 | see Ex. 28 | 3.0 | — | 0 |
| 35 | Ca complex | — | 0 | DTPE of Ex. B | 2.0 | NA-SUL ™ EDS | 3.0 |
| 36 | Ca complex | see Ex. 27 | 1.0 | same | 1.0 | same | 0.3 |
| 37 | clay in oil | see Ex. 28 | 2.0 | same | 2.0 | see Ex. 27 | 0.5 |
| 38 | polyurea | TPTP | 2.0 | same | 2.0 | see Ex. 28 | 0.5 |

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A functional fluid comprising:

(a) an oil of lubricating viscosity;

(b) the reaction product of an amine and a sulfonic acid; and (c) a mixture comprising (i) a triarylthiophosphate; and (ii) a compound of the structure $$(RO)_2\overset{\overset{\displaystyle X}{\|}}{P}-X_a-R''$$

where a is zero or 1, each X is independently sulfur or oxygen, provided that at least one X is sulfur, and each R and R" is independently an alkyl group or a substituted alkyl group;

wherein components (i) and (ii) together provide at least 0.04 percent by weight phosphorus to the functional fluid, and wherein the ratio of the amounts of (i) and (ii), by weight, is about 20:80 to about 60:40.

2. The functional fluid of claim 1 wherein the reaction product of an amine and a sulfonic acid is an amine salt of the sulfonic acid.

3. The functional fluid of claim 1 wherein the sulfonic acid is an aromatic sulfonic acid.

4. The functional fluid of claim 3 wherein the aromatic sulfonic acid is substituted with at least one alkyl group.

5. The functional fluid of claim 4 wherein the aromatic sulfonic acid is an alkyl-substituted naphthalenesulfonic acid.

6. The functional fluid of claim 5 wherein the aromatic sulfonic acid is dinonylnaphthalenesulfonic acid.

7. The functional fluid of claim 1 wherein the amine is a diamine.

8. The functional fluid of claim 7 wherein the amine is ethylenediamine.

9. The functional fluid of claim 1 wherein the triarylthiophosphate of component (c)(i) is triphenylmonothiophosphate.

10. The functional fluid of claim 1 wherein the structure of (c)(ii) represents a dithiophosphate ester.

11. The functional fluid of claim 10 wherein the dithiophosphate ester is a material of the structure:

$$(RO)_2-\overset{\overset{\displaystyle S}{\|}}{P}-S-R'$$

wherein each R is an alkyl group or an alkoxyalkyl group and R' is a carboxylic acid- or carboxylic ester-substituted alkyl group.

12. The functional fluid of claim 11 wherein R' is a carboxylic ester-substituted alkyl group.

13. The functional fluid of claim 12 wherein each R group is a branched alkyl group of up to 8 carbon atoms and R' is $-CH_2CH_2CO_2CH_3$.

14. The functional fluid of claim 13 wherein the R groups are a mixture of 4- and 5-carbon alkyl groups.

15. The functional fluid of claim 1 wherein the amount of product of the amine and the sulfonic acid is about 0.005 to about 3 weight percent of the fluid.

16. The functional fluid of claim 1 wherein the amount of the product of the amine and the sulfonic acid is about 0.01 to about 0.2 weight percent.

17. The functional fluid of claim 1 wherein the amount of the mixture of compounds of component (c) is about 0.02 to about 5 weight percent of the fluid.

18. The functional fluid of claim 1 wherein the amount of the mixture of compounds of component (c) is about 0.2 to about 2 weight percent.

19. The functional fluid of claim 1 further comprising at least one antioxidant.

20. The functional fluid of claim 19 wherein the antioxidant is selected from aromatic amines, hindered phenols, and mixtures thereof.

21. The functional fluid of claim 19 wherein the amount of the antioxidant is about 0.02 to about 2 weight percent of the fluid.

22. The functional fluid of claim 1 containing less than about 0.05 percent by weight metal.

23. A functional fluid comprising:

(a) an oil of lubricating viscosity;

(b) a triarylthiophosphate; and (c) a compound of the structure $$(RO)_2\overset{\overset{X}{||}}{P}-X_a-R''$$

where a is zero or 1, each X is independently sulfur or oxygen, provided that at least one X is sulfur, and each R and R" is independently an alkyl group or a substituted alkyl group;

wherein components (b) and (c) together provide at least 0.04 percent by weight phosphorus to the functional fluid, and wherein the ratio of the amounts of (b) and (c), by weight, is about 20:80 to about 60:40.

24. The functional fluid of claim 23 wherein (c) is a compound of the structure $$(RO)_2\overset{\overset{X}{||}}{P}-S_a-R''.$$

25. The functional fluid of claim 23 wherein R" is an alkyl group substituted at the α or β position by an amino group, an alkanoate group, or an alkyl ester group.

26. The functional fluid of claim 24 wherein a is 1 and X is sulfur.

27. The functional fluid of claim 23 wherein R and R" are n-butyl.

28. The functional fluid of claim 23 wherein the number of sulfur atoms in the compound of (c) is two.

29. The functional fluid of claim 26 wherein R is an alkyl group of 1 to 11 carbon atoms.

30. The functional fluid of claim 23 wherein the triarylthiophosphate of (b) is present in an amount of about 0.05 to about 2 weight percent and the compound of (c) is present in an amount of about 0.05 to about 2 weight percent.

31. A grease comprising:

(a) an oil of lubricating viscosity;

(b) a thickener;

(c) the reaction product of an amine and a sulfonic acid; and (d) a composition comprising a mixture of a triarylmonothiophosphate and a second phosphorus-containing material having a structure $$(RO)_2\overset{\overset{X}{||}}{P}-X_a-R''$$

where a is zero or 1, each X is independently sulfur or oxygen, provided that at least one X is sulfur, and each R and R" is independently an alkyl group or a substituted alkyl group;

wherein components (b) and (c) together provide at least 0.04 percent by weight phosphorus to the grease, and wherein the ratio of the amounts of (b) and (c), by weight, is about 20:80 to about 60:40.

32. The grease of claim 31 wherein the reaction product of an amine and a sulfonic acid is the salt of an amine and an alkyl-substituted aromatic sulfonic acid.

33. The grease of claim 32 wherein the salt is the salt of dinonylnaphthalenesulfonic acid and ethylenediamine.

34. The grease of claim 31 wherein the triarylthiophosphate is triphenylmonothiophosphate.

35. The grease of claim 31 wherein the R groups are a mixture of branched 4- and 5-carbon alkyl groups and R' is $-CH_2CH_2CO_2CH_3$.

36. The grease of claim 31 wherein the amount of product of the amine and the sulfonic acid (c) is about 0.05 to about 10 weight percent of the grease and the amount of the compound of component (d) is about 0.5 to about 8 weight percent of the grease.

37. The grease of claim 31 wherein the thickener is a metal salt of a fatty acid.

38. A grease comprising:

(a) an oil of lubricating viscosity (b) a thickener;

(c) a mixture of compounds comprising (i) a triarylthiophosphate; and (ii) a compound of the structure $$(RO)_2\overset{\overset{X}{||}}{P}-X_a-R''$$

where a is zero or 1, each X is independently sulfur or oxygen, provided that at least one X is sulfur, and each R and R" is independently an alkyl group or a substituted alkyl group;

wherein components (b) and (c) together provide at least 0.04 percent by weight phosphorus to the grease, and wherein the ratio of the amounts of (b) and (c), by weight, is about 20:80 to about 60:40.

39. The grease of claim 38 wherein R" is an alkyl group substituted at the α or β position by an amino group, an alkanoate group, or an alkyl ester group.

40. The grease of claim 38 wherein the number of sulfur atoms in the compound of (d)(ii) is or two.

41. The grease of claim 38 wherein R is an alkyl group of 1 to 12 carbon atoms.

42. The grease of claim 38 wherein the triarylmonothiophosphate of (c)(i) is present in an amount of about 0.5 to about 4 weight percent and the compound of (c)(ii) is present in an amount of about 0.5 to about 4 weight percent.

43. A concentrate comprising:

(a) a concentrate-forming amount of an oleophilic medium, (b) a triarylthiophosphate; and (c) a compound of the structure $$(RO)_2\overset{\overset{X}{||}}{P}-X_a-R''$$

where a is zero or 1, each X is independently sulfur or oxygen, provided that at least one X is sulfur, and each R and R" is independently an alkyl group or a substituted alkyl group;

wherein the ratio of the amounts of (b) and (c), by weight, is about 20:80 to about 60:40.

44. The concentrate of claim 43 further comprising (d) an amine salt of a sulfonic acid.

* * * * *